US007721507B2

(12) United States Patent
Miller et al.

(10) Patent No.: US 7,721,507 B2
(45) Date of Patent: May 25, 2010

(54) MOUNTING BRACKET FOR COLUMN ASSEMBLY

(75) Inventors: Les Miller, Ligoneir, IN (US); Dave Miller, Middlebury, IN (US); Carl Almeter, East Amherst, NY (US)

(73) Assignee: Architectural Composite Technologies, LLC, Elkhart, IN (US)

( * ) Notice: Subject to any disclaimer, the term of this patent is extended or adjusted under 35 U.S.C. 154(b) by 552 days.

(21) Appl. No.: 11/700,756

(22) Filed: Jan. 31, 2007

(65) Prior Publication Data

US 2008/0179472 A1 Jul. 31, 2008

(51) Int. Cl.
*E04C 3/00* (2006.01)

(52) U.S. Cl. ..... 52/835; 248/200; 248/200.1; 248/534; 256/65.14

(58) Field of Classification Search ..... 52/146, 52/218, 219, 200.1, 223.4, 252, 311.1, 479, 52/480, 568, 736.1, 835, 848, 849, 3; 248/200, 248/200.1, 534, 535, 536, 903; 256/65.14, 256/DIG. 5

See application file for complete search history.

(56) References Cited

U.S. PATENT DOCUMENTS 4,328,651 A * 5/1982 Gutierrez ..... 52/293.1
5,263,297 A * 11/1993 Kim ..... 52/834
5,335,471 A * 8/1994 Kupiec ..... 52/834
5,553,433 A * 9/1996 Lang ..... 52/483.1
5,881,512 A * 3/1999 Chang ..... 52/220.2
5,901,525 A * 5/1999 Doeringer et al. ..... 52/835
5,934,035 A * 8/1999 Rasmussen et al. ..... 52/300
6,581,335 B2 * 6/2003 Grant ..... 52/28
7,165,690 B2 * 1/2007 Wu ..... 211/192
7,191,573 B1 * 3/2007 Newton, II ..... 52/834
7,455,282 B2 * 11/2008 Platt ..... 256/59
2006/0022188 A1 * 2/2006 Collins, IV ..... 256/65.14
2006/0032184 A1 2/2006 Almeter

OTHER PUBLICATIONS

Foam Geometrix, Inc., "Innovative Products—Open Minds," http://foamgeometrix.virtuo.biz/en/ (2007).
AFS, Inc., "Architectural Foam Supply," http://www.foamsupply.com/products/cfm/ (2002).

* cited by examiner

*Primary Examiner*—Richard E Chilcot, Jr.
*Assistant Examiner*—Theodore Adamos
(74) *Attorney, Agent, or Firm*—Barnes & Thornburg LLP

(57) ABSTRACT

A mounting bracket for a prefabricated column assembly comprising a column having an external wall and an internal wall defining a channel for receiving a mounting post, the mounting bracket configured to be received by the channel having a body defining a hole for receivingly engaging the mounting post and having a peripheral edge. The peripheral edge defining a slot for receiving an elongated support strip for providing a lateral support anchor for the column assembly.

17 Claims, 5 Drawing Sheets

MOUNTING BRACKET FOR COLUMN ASSEMBLY

FIELD

The present disclosure relates to a mounting bracket for a column assembly, such as, for example, a prefabricated outdoor column assembly or the like.

BACKGROUND

Outdoor columns are typically constructed with masonry building materials such as concrete, cement mortar, reinforcing steel bar, clay, marble, brick, stone or stackable pre-cast concrete block of various shapes to achieve a column. Often these columns are in the form of prefabricated column assemblies adapted to be installed on site by a mounting post secured to the ground. These materials require extensive labor, packaging and heavy equipment to transport to and install at the installation site.

SUMMARY

The present disclosure relates to a mounting bracket for a prefabricated column assembly comprising a column having an external wall and an internal wall defining a channel for receiving a mounting post. The mounting bracket has a body defining a hole for receivingly engaging the mounting post. The mounting bracket also defines a slot for receiving a support strip for providing a lateral support anchor for the prefabricated column assembly for supporting a fence or other structure. The mounting bracket may include a plurality of the slots for receiving other support strips. The mounting bracket may be square or otherwise rectangular and may be generally symmetrical to provide further benefits.

The present disclosure also relates to a prefabricated column assembly including one or more of the mounting brackets. The prefabricated column assembly may include a pair of the mounting brackets spaced from each other to provide additional alignment benefits. The slots of each mounting bracket align with slots of the other mounting bracket so that each pair of aligned slots may receive a corresponding one of the support strips to provide further benefits.

Features and advantages of the disclosure will be set forth in part in the description which follows and the accompanying drawings described below, wherein an embodiment of the disclosure is described and shown, and in part will become apparent upon examination of the following detailed description taken in conjunction with the accompanying drawings.

BRIEF DESCRIPTION OF THE DRAWINGS

The present disclosure and the advantages thereof will become more apparent upon consideration of the following detailed description when taken in conjunction with the accompanying drawings.

DETAILED DESCRIPTION

Figure 1:
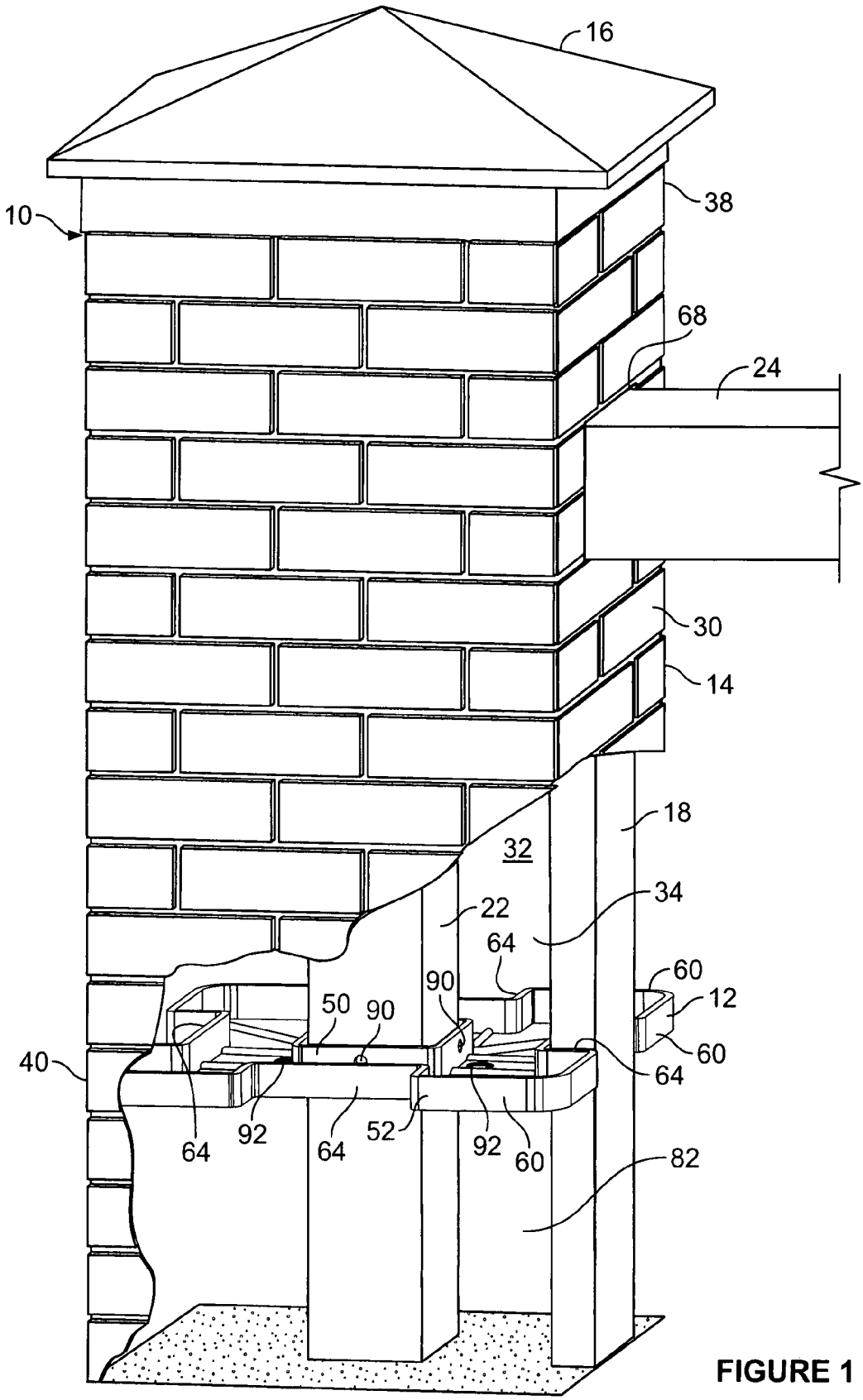
FIG. 1 is a perspective view of a prefabricated column assembly shown in broken to illustrate one of the mounting brackets of the assembly in accordance with an embodiment of the present disclosure engaging the prefabricated column assembly with a mounting post and a partial view of a fence secured to the prefabricated column assembly.
Figure 2:
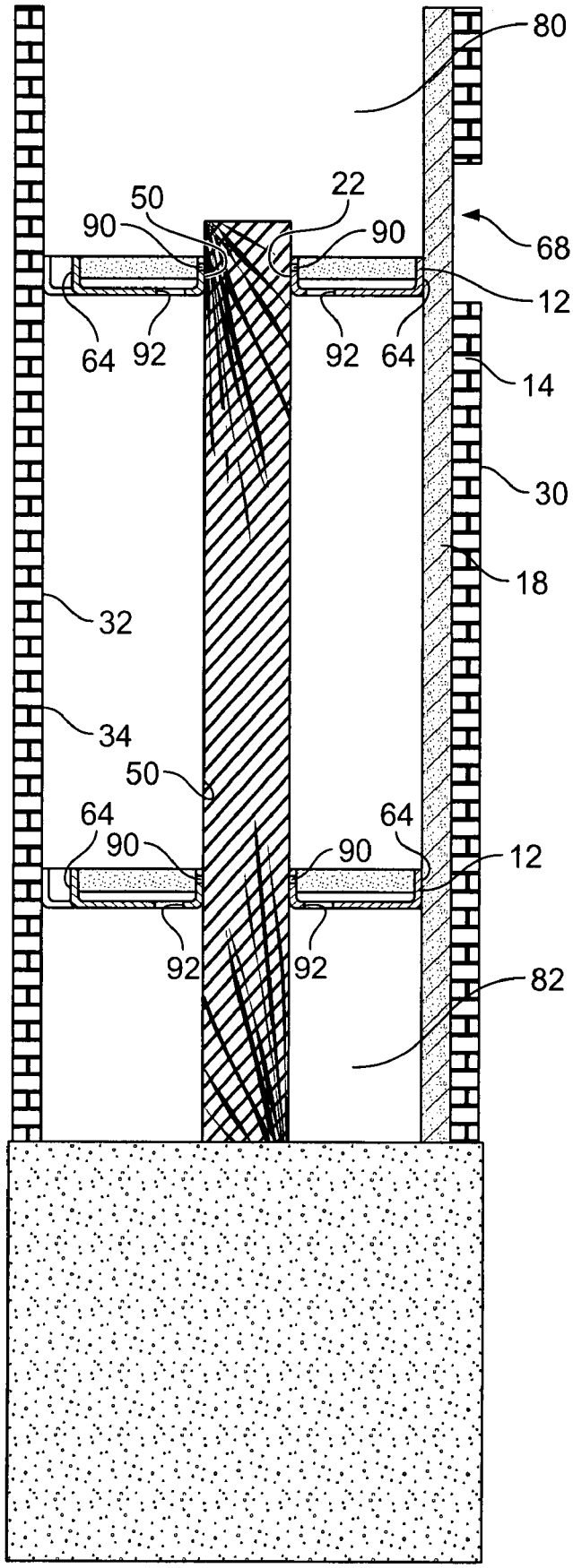
FIG. 2 is a cross section of the column of the prefabricated column assembly and the mounting post of FIG. 1.
Figure 3:
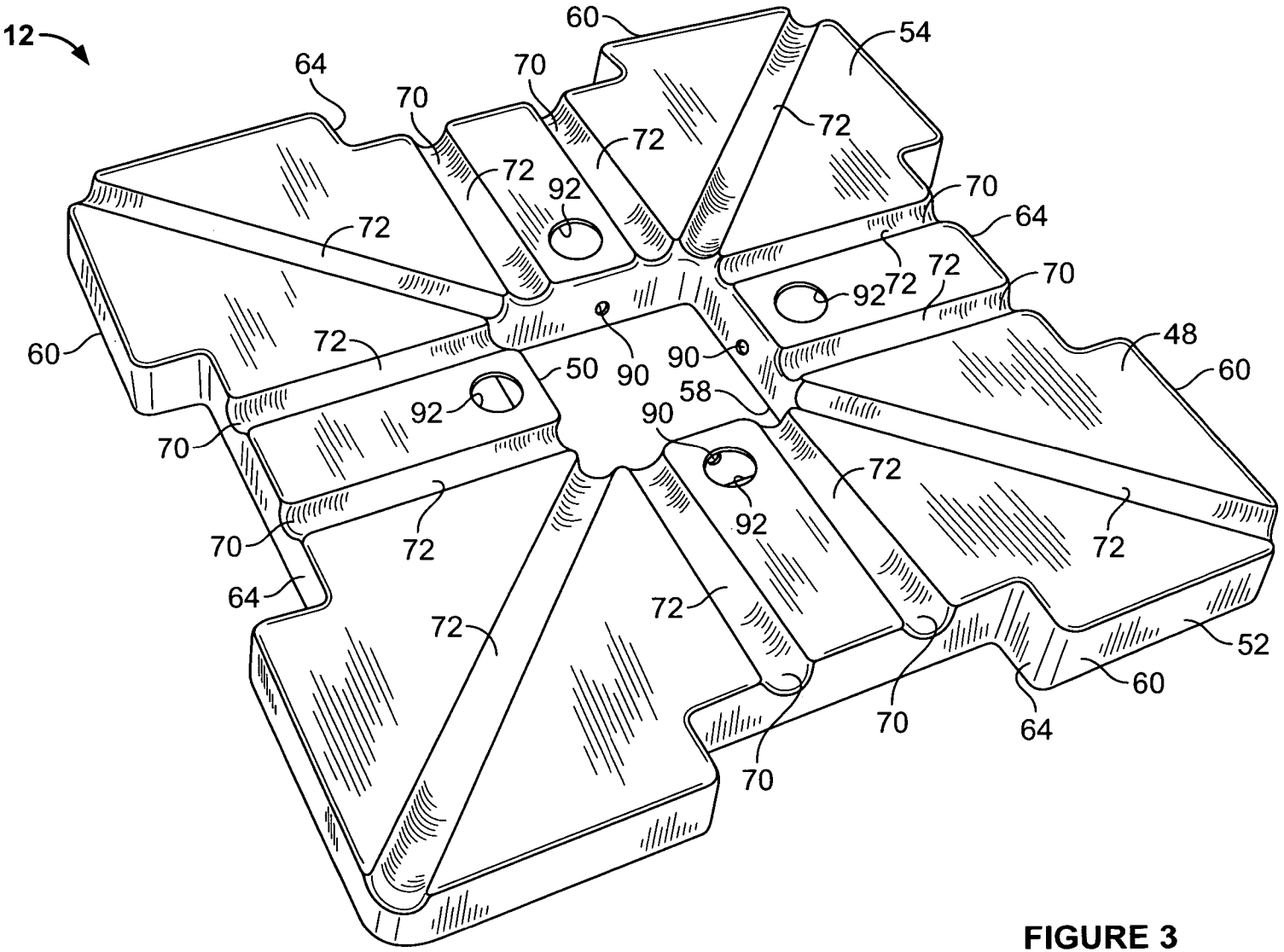
FIG. 3 is a top plan view of the mounting bracket of FIG. 1.
Figure 4:
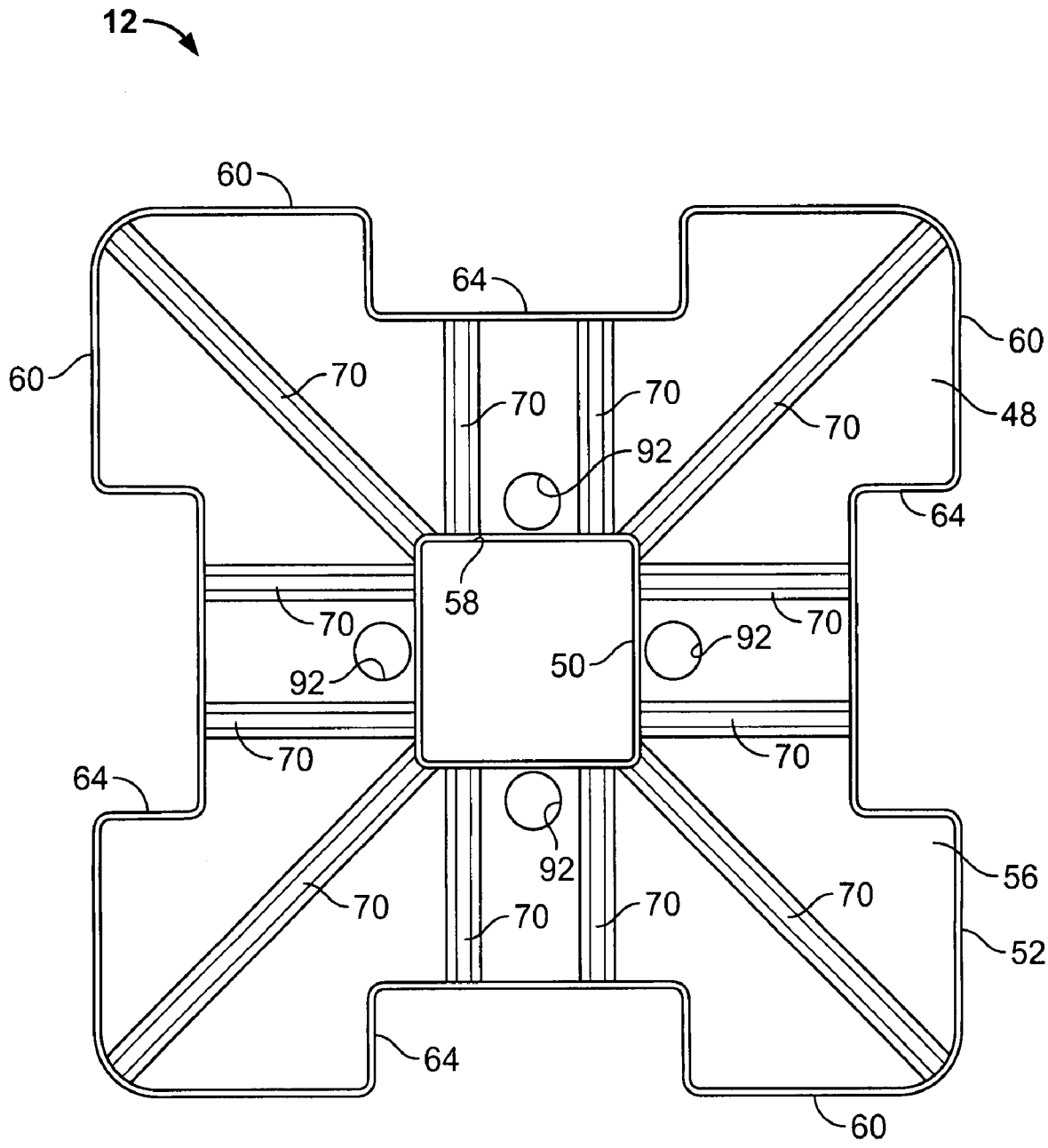
FIG. 4 is a perspective bottom view of the mounting bracket of FIG. 1.

While the present disclosure may be susceptible to embodiment in different forms, there is shown in the drawings, and herein will be described in detail, an embodiment with the understanding that the present description is to be considered an exemplification of the principles of the disclosure and is not intended to limit the disclosure to the details of construction, methods and the arrangements of components set forth in the following description or illustrated in the drawings.

FIGS. 1-4 disclose a prefabricated column assembly 10 including a pair of mounting brackets 12 in accordance with an illustrated embodiment of the present disclosure, a column 14, a decorative top cover 16, and a support strip 18 secured to the pair of mounting brackets 12; a mounting post 22 engaged with the mounting brackets 12 securing the prefabricated column assembly 10 in place; and a structure in the form of a fence 24 secured to the support strip 18 of the prefabricated column assembly 10. The column 14 has a generally square or otherwise rectangular cross section substantially along the length and is constructed of masonry materials. The column 14 may have any other suitable configuration and may be constructed of any other suitable materials in accordance with other embodiments of the present disclosure. The column 14 includes an external wall 30, an internal wall 32 that defines a channel 34 substantially along the length of the column 14, a top 38 and a bottom 40. The channel 34 has a cross section that is generally square or otherwise rectangular substantially along the length of the column 14. The mounting post 22 may be secured to the ground with cement or the like or in any other suitable manner.

Each of the mounting brackets 12 in accordance with the illustrated embodiment of the present disclosure includes a body 48 that defines a central hole 50 and a peripheral edge 52. The central hole 50 is square or otherwise rectangular and sized to slidingly and receivingly engage the mounting post 22 which may, for example, be in the form of a 4"×4" wood, PVC, steel or aluminum post or may have any other size or construction. The body 48 extends from the central hole 50 to the peripheral edge 52, and includes a bottom side 54 and a top side 56. The mounting bracket 12 is generally square or otherwise rectangular and is sized to be snugly received by the channel 34 of the column 14. Each mounting bracket further includes an internal flange 58 further defining the central hole 50.

The peripheral edge 52 of each mounting bracket 12 is in the form of a flange that extends at a 90 degree angle from the body 48 and extends around the periphery of the body 48. In the illustrated embodiment, the flange extends upward from the body 48 when the mounting bracket 12 is disposed within the channel 34 of the column 14. The peripheral edge 52 engages by contact the internal wall 32 of the column 14. An adhesive or the like may be used to secure the peripheral edge 52 to the internal wall 32 to position the mounting bracket 12 at a desired location. The peripheral edge 52 may have any other suitable configuration in accordance with other embodiments of the present disclosure.

The mounting bracket 12 is generally symmetrical in the lateral direction, and includes four sides 60. The body 48 and the peripheral edge 52 define a slot 64 disposed at the center of each side 60 of the mounting bracket. Each of the slots 64 has an open side facing laterally outward, and is configured to receive a respective support strip 18 to provide a lateral anchor support for securing the fence 24 or for securing any other structure to the prefabricated column assembly 10 including for example, gates, signage, mailboxes, lights, etc. The support strip 18 extends parallel to the mounting post 22. Each mounting bracket 12 may receivingly engage four support strips 18.

The fence 24 or other structure may be secured to the support strip 18 by any suitable fasteners (not shown) or by any other suitable means. A portion of the fence 24 or other structure and/or the fasteners may extend through an opening 68 defined by the column 14 to secure the fence 24 or other structure to the support strip 18. The opening 68 may be any size and configuration and may be defined anywhere on the column 14 that enables the fence 24 or other structure to be secured to the support strip 18. Further, if more than one support strip 18 is engaged with the mounting brackets 12, openings 68 may be included corresponding to each of the other support strips. Still further, more than one opening 68 may be formed for one or more of the support strips 18 to enable the fence 24 or other structure to be secured to the support strip at more than one location on the support strip.

Each of the slots 64 of one of the mounting brackets 12 vertically aligns with a respective one of the slots 64 of the other mounting bracket 12. Thus, the support strip 18 extends vertically from one of the slots 64 of one of the mounting brackets 12 to one of the slots 64 of the other mounting bracket 12 aligned therewith. The support strip 18 may be secured within the aligned slots 64 of the mounting brackets 12 or to the internal wall 32 (or both) with an adhesive or the like or by any other suitable means, or may otherwise be lodged within the aligned slots. The support strip 18 may be in the form of a strip of decking material or any other strip of wood or other suitable material. In the illustrated embodiment of the present disclosure, each slot 64 may be 1"×6", but may have any other suitable size and configuration in accordance with other embodiments. Further, the fasteners may be any suitable type and the opening 68 defined by the column 14 may have any suitable configuration.

One support strip 18 can be disposed within any of the aligned pairs of slots 64 of the mounting brackets 12 (e.g., on any of the sides 60 of the mounting brackets) depending upon where the fence 24 or other structure will be secured to the prefabricated column assembly 10. If the fence 24 or other structure is disposed on more than one side of the column 14, other support strips 18 can be disposed within other aligned pairs of slots 64. Thus, each of the mounting brackets 12 provides four different locations for receiving support strips 18 so that fences 24 or other structures can be secured to the prefabricated column assembly 10 on all sides of the column 14.

The body 48 of each mounting bracket 12 also includes a plurality of ribs 70 extending from the hole 50 to the peripheral edge 52 to provide increased rigidity to the mounting bracket. Each rib 70 is in the form an indentation have an arcuate cross section, protruding from the top side 56 of the body 48 and defining corresponding channels 72 on the bottom side 54 of the body 48. The indentations may be disposed at any other suitable locations and have any other suitable configurations in accordance with other embodiments of the present disclosure. The mounting brackets 12 may be constructed of any suitable material, such as, for example, ABS plastic or any other suitable plastic or non-plastic material.

In the illustrated embodiment, two mounting brackets 12 are disposed within the channel 34 and vertically spaced from each other to provide alignment benefits. Additionally, the upper of the two mounting brackets 12 may be spaced from the top 38 of the column 14 to provide space 80 for any desired column accessories such as, for example, a mailbox (not shown) or any other materials or structure. The mailbox or such other materials or structure may be supported by the top side 56 of the upper mounting bracket 12. The lower of the two mounting brackets 12 may be spaced from the bottom 40 of the column 14 to provide space 82 to install and house conduit or any other suitable electric or other materials, structure or accessories. One or both of the mounting brackets 12 may instead be positioned at other locations along the mounting post 22, and more than two or less than two mounting brackets 12 may instead be used in accordance with other embodiments of the present disclosure.

The mounting brackets 12 may be secured to the mounting post 22 in any suitable manner. For example, an adhesive or the like may secure the flange 58 of the mounting brackets 22 to the mounting post 22. In the illustrated embodiment, four apertures 90 are defined by the flange 58 symmetrically disposed about the hole 50. Fasteners (not shown) or the like may be inserted through one or more of the apertures 90 to secure the bracket 12 to the mounting post. The flange 58 may define any other number of apertures 90 and the apertures 90 may be positioned anywhere else on the flange or mounting bracket 12 in accordance with other embodiments of the present disclosure.

The body 48 of each mounting bracket 12 may define four apertures 92 symmetrically disposed about the hole 50 for receiving electrical conduit 200 (see FIG. 5) or any other conduit or structure. The conduit 200 may, for example, be used to provide electrical connection to accessories of the prefabricated column assembly. The body 48 may define any other number of apertures 92 and the apertures 92 may be positioned anywhere else in the body 48 in accordance with other embodiments of the present disclosure.

Figure 5:
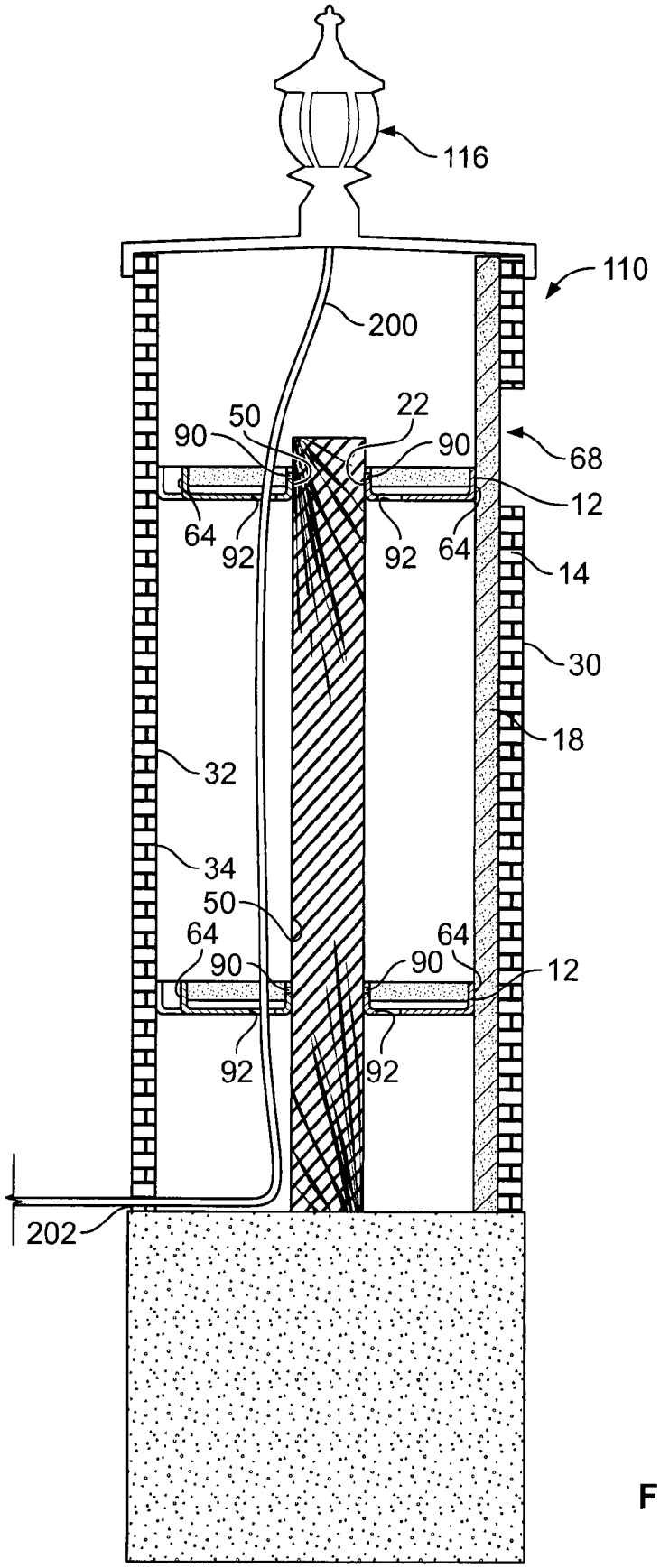
FIG. 5 is a cross section of a prefabricated column assembly in accordance with an other embodiment of the present disclosure.

FIG. 5 illustrates a prefabricated column assembly 110 in accordance with an other embodiment of the present disclosure including a pair of the mounting brackets 12. The prefabricated column assembly 110 is substantially identical to the prefabricated column assembly 10 of FIGS. 1 and 2 except that a decorative cover 116 includes a light and the conduit 200 is shown extending from the light to the exterior of the column 14. The conduit 200 extends from the light through one of the apertures 92 of each of the brackets 12 and through an aperture 202 defined by the column 14.

The prefabricated column assembly 10 having the pair of mounting brackets 12 in accordance with the present disclosure may provide many advantages. For example, the prefabricated column assembly 10 is readily securable to the mounting post 22, and a plurality of the prefabricated column assemblies therefore can be readily installed to mounting posts in an efficient manner. Because of their structure and positions, the mounting brackets 12 also provide alignment benefits in connection with securing the prefabricated column assembly to the mounting post 22. Further, the slots 64 allow the prefabricated column assemblies 10 to be used to secure the fence 24 or any other structure to the prefabricated column assembly, providing lateral support for the fence or other structure. Still further, because each mounting bracket 12 includes four slots 64, the mounting bracket is capable of providing lateral support on four different sides and, because the mounting bracket is symmetrical, it can provide these benefits and still be easily engageable with the column 14.

The prefabricated column assembly 10 and 110 may have any other suitable configuration and construction in accordance with other embodiments of the present disclosure. For example, the column 14 may have a circular cross section or any other suitable cross section, the decorative cover 16 and 116 may be in any other suitable form or may be excluded, and any suitable accessories or attachments may be included with the prefabricated column assembly 10 and 110. Further, the mounting bracket 12 may also have any other suitable configuration in accordance with other embodiments of the present disclosure. For example, the mounting bracket 12 may have a circular cross section or any other suitable cross section, and may or may not be symmetrical in accordance with other embodiments of the present disclosure. Further, the slots 64 may have any other suitable configuration, location and number in accordance with other embodiments of the present disclosure.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the disclosure are desired to be protected. The description and figures are intended as illustrations of embodiments of the disclosure, and are not intended to be construed as having or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. A prefabricated column assembly comprising a column having an external wall and an internal wall defining a channel receiving a mounting post, the column having a length and being elongated in the direction of its length, a mounting bracket received by the channel, the mounting bracket having a body defining a hole engaging the mounting post and having a peripheral edge, the peripheral edge comprising a flange extending around the periphery of the body, extending at an angle of about 90° from the body, the flange defining a slot in the peripheral edge of the body and receiving a support strip extending substantially parallel to the length of the column into the slot of the mounting bracket for providing a lateral support anchor for securing to the prefabricated column assembly structure disposed outside the prefabricated column assembly, the slot having an open side facing laterally outward from the body.

2. The prefabricated column assembly of claim 1 wherein the flange defines a plurality of the slots, each slot configured to receive a respective support strip extending substantially parallel to the column through the mounting bracket for providing a respective lateral support anchor for securing to the prefabricated column assembly respective structure disposed outside the prefabricated column assembly.

3. The prefabricated column assembly of claim 1 wherein the mounting bracket is generally rectangular and laterally symmetrical.

4. The prefabricated column assembly of claim 3 wherein the flange defines four slots and wherein the mounting bracket has four peripheral sides, one slot defined on a respective peripheral side, each slot configured to receive a respective support strip extending substantially parallel to the column for providing a respective lateral support anchor for securing to the prefabricated column assembly respective structure disposed outside the prefabricated column assembly.

5. The prefabricated column assembly of claim 4 wherein each slot is centered along its respective peripheral side.

6. The prefabricated column assembly of claim 1 wherein the slot is generally rectangular and is elongated in a plane generally perpendicular to the length of the column.

7. The prefabricated column assembly of claim 1 wherein the mounting bracket includes a plurality of ribs providing rigidity to the mounting bracket.

8. The prefabricated column assembly of claim 7 wherein each of the ribs extends from the hole to the peripheral edge.

9. The prefabricated column assembly of claim 1 wherein the peripheral edge of the mounting bracket is configured to be secured to the internal wall of the column with an adhesive.

10. The prefabricated column assembly of claim 1 wherein the body defines at least one aperture for receiving conduit.

11. The prefabricated column assembly of claim 1, the flange further defining at least one aperture for receiving a fastener to secure the mounting bracket to the mounting post.

12. The prefabricated column assembly of claim 1 comprising an other mounting bracket, the mounting brackets spaced apart from each other within the channel.

13. The prefabricated column assembly of claim 12 wherein the column has a top and a bottom, one of the mounting brackets is spaced from the top of the column to define a space within the channel.

14. The prefabricated column assembly of claim 13 wherein the other of the mounting brackets is spaced from the bottom of the column to define an other space within the channel.

15. The prefabricated column assembly of claim 12 wherein the slots are vertically aligned with each other for receiving the support strip.

16. The prefabricated column assembly of claim 12 wherein the flange of each mounting bracket defines a plurality of the slots, each slot of each mounting bracket aligned with a respective slot of the other mounting bracket, each aligned pair of slots configured to receive a respective support strip extending substantially parallel to the column for providing a respective lateral support anchor for securing respective structure disposed outside the prefabricated column assembly.

17. The prefabricated column assembly of claim 16 wherein each mounting bracket is generally rectangular having four sides, each slot of the mounting bracket being defined on a respective side of the mounting bracket.

* * * * *